US008011969B2

(12) United States Patent
Wang et al.

(10) Patent No.: US 8,011,969 B2
(45) Date of Patent: Sep. 6, 2011

(54) ELECTRICAL CONNECTOR WITH CONTACT MODULES

(75) Inventors: Li-Jiang Wang, Kunshan (CN); Jia-Yong He, Kunshan (CN); Zhong-Hua Yao, Kunshan (CN); Qi-Sheng Zheng, Kunshan (CN)

(73) Assignee: Hon Hai Precision Ind. Co., Ltd., New Taipei (TW)

( * ) Notice: Subject to any disclaimer, the term of this patent is extended or adjusted under 35 U.S.C. 154(b) by 0 days.

(21) Appl. No.: 12/826,702

(22) Filed: Jun. 30, 2010

(65) Prior Publication Data

US 2010/0330849 A1 Dec. 30, 2010

(30) Foreign Application Priority Data

Jun. 30, 2009 (CN) ..... 2009 2 0305336.3

(51) Int. Cl.
*H01R 13/648* (2006.01)

(52) U.S. Cl. ..... 439/660; 439/701; 439/607.35; 439/607.54

(58) Field of Classification Search ..... 439/660, 439/701, 607.35, 607.39, 607.01, 607.54
See application file for complete search history.

(56) References Cited

U.S. PATENT DOCUMENTS

| | | | | |
|---|---|---|---|---|
| 5,167,531 | A * | 12/1992 | Broschard et al. | 439/541.5 |
| 6,238,244 | B1 * | 5/2001 | Yang | 439/607.01 |
| 6,419,529 | B1 * | 7/2002 | Shi et al. | 439/701 |
| 7,371,118 | B2 * | 5/2008 | Wu | 439/607.45 |
| 7,452,243 | B2 | 11/2008 | Wan et al. | |
| 7,628,655 | B1 * | 12/2009 | Chen | 439/660 |
| 7,748,997 | B2 * | 7/2010 | Hamner et al. | 439/79 |
| 7,811,131 | B2 * | 10/2010 | Wang et al. | 439/607.35 |
| 7,862,378 | B1 * | 1/2011 | Wan et al. | 439/607.35 |
| 2005/0014418 | A1 * | 1/2005 | Ji et al. | 439/660 |
| 2010/0022135 | A1 | 1/2010 | Hamner et al. | |
| 2010/0124851 | A1 * | 5/2010 | Xiong et al. | 439/660 |
| 2010/0167583 | A1 * | 7/2010 | Lin et al. | 439/607.01 |

* cited by examiner

*Primary Examiner* — Gary F. Paumen
(74) *Attorney, Agent, or Firm* — Wei Te Chung; Andrew C. Cheng; Ming Chieh Chang

(57) ABSTRACT

An electrical connector includes an insulative housing including a base portion and mating tongue plate protruding forwardly from the base portion; two contact modules being retained with each other and each including an insulative block, and a row of contacts being insert molded in the insulative housing, and a metal shell enclosing the insulative housing and the contact modules. A receiving space is formed between the shell and the tongue plate. The insulative blocks each defines a front portion inserted in the cavity of the insulative housing for the contact modules being retained with the insulative housing reliably.

20 Claims, 7 Drawing Sheets

ELECTRICAL CONNECTOR WITH CONTACT MODULES

BACKGROUND OF THE INVENTION

1. Field of the Invention

The present invention relates to an electrical connector, and more particularly to an electrical connector with contact modules.

2. Description of Related Art

With the development of the electrical industry, electrical connectors are employed widely with peripherals to transmit various signals with each other. An electrical connector usually comprises an insulative housing, a plurality of contacts retained in the insulative housing and a metal shell enclosing the insulative housing. The insulative housing defines a plurality of contact passageways. In conventional methods for manufacturing the electrical connector, an inserting method is adopted to insert rows of contacts into the passageways of the insulative housing from a rear end. The contacts are then forced into the housing. The contacts are manufactured by means of stamping.

However, such an inserting method will damage the mechanical and electrical performance of the electrical connector. Especially in a miniature electrical connector, the contacts and contact passageways are arranged closely. Side walls of the contact passageways are weak. Since the contacts interferentially engage with the side walls of the contact passageways, the contacts may wear away surfaces of the side walls. Thereby, the adjacent contacts will contact with each other and adversely affect signal transmission.

Hence, an improved electrical connector to overcome the above problems.

BRIEF SUMMARY OF THE INVENTION

According to one aspect of the present invention, an electrical connector comprises an insulative housing including a base portion and a mating tongue plate protruding forwardly from the base portion, the tongue plate defining a plurality of passageways, the base portion having a cavity extending rearwardly therethrough and a plurality of through holes extending forwardly therein and communicating with the passageways and the cavity; two contact modules retained with each other and each including an insulative block, and a row of contacts being insert molded in the insulative housing, the contacts defining contact portions protruding forwardly beyond the insulative block, and soldering tails extending beyond the insulative block to be soldered to a printed circuit board, the contact portions passing through the through holes and being received in the passageways of the tongue plate; and a metal shell enclosing the insulative housing and the contact modules, a receiving space being formed between the shell and the tongue plate; wherein the insulative blocks each defines a front portion retained in the cavity of the insulative housing for the contact modules being retained with the insulative housing reliably.

According to another aspect of the present invention, an electrical connector defines a receiving space for receiving a plug, and comprises an front insulative housing including a base portion defining a cavity communicating with the receiving space, and a tongue plate extending into the receiving space from the base portion along a length direction thereof; two rear contact modules being assembled together along a transverse direction perpendicular to the length direction, and each including a insulative block and a row of contacts being insert molded in the insulative block, the contacts each including a contact portion located on the tongue plate and exposed to the receiving space for mating with the plug, and a soldering tail extending beyond the insulative block for being soldered to a printed circuit board; and a metal shell attached to at least one of the insulative housing and the contact modules, and enclosing the tongue plate to form the receiving space; wherein the insulative blocks each includes a front portion inserted in the cavity and a rear end portion connect to the front portion, the rear end portions of the insulative blocks are disposed on exterior of the cavity.

The foregoing has outlined rather broadly the features and technical advantages of the present invention in order that the detailed description of the invention that follows may be better understood. Additional features and advantages of the invention will be described hereinafter which form the subject of the claims of the invention.

BRIEF DESCRIPTION OF THE DRAWINGS

For a more complete understanding of the present invention, and the advantages thereof, reference is now made to the following descriptions taken in conjunction with the accompanying drawings, in which.

DETAILED DESCRIPTION OF THE PREFERRED EMBODIMENT

Figure 1:
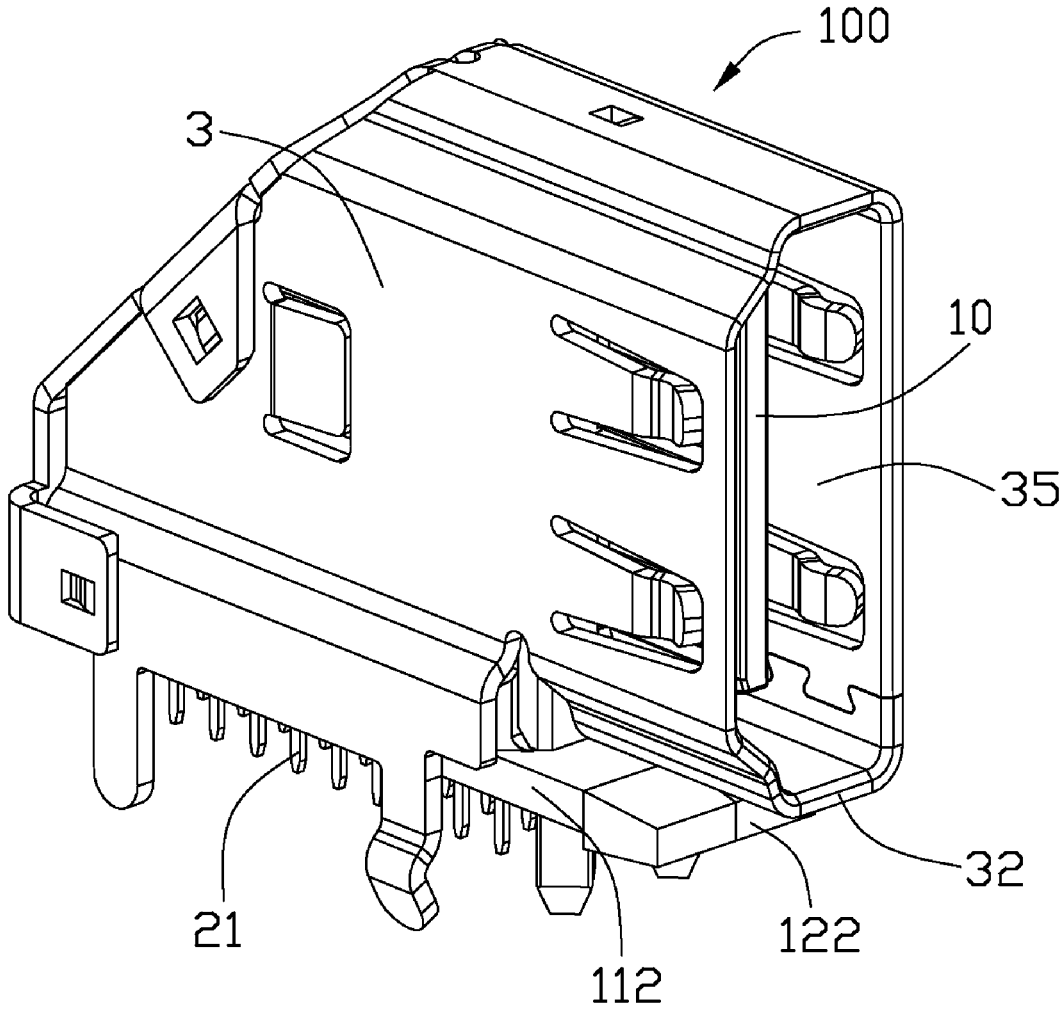
FIG. 1 is a front perspective view of an electrical connector according to an embodiment of the present invention.
Figure 2:
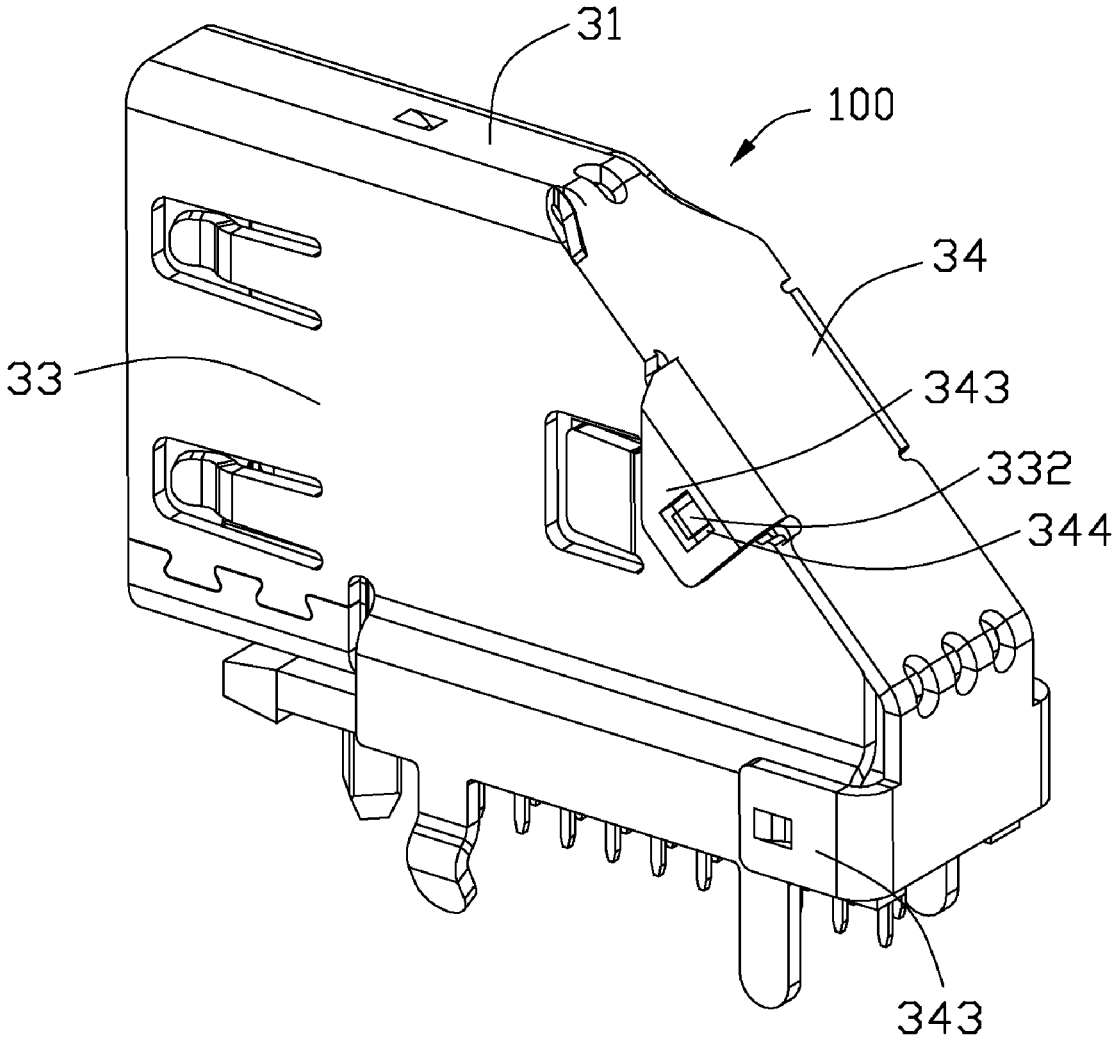
FIG. 2 is a rear perspective view of the electrical connector shown in FIG. 1.
Figure 3:
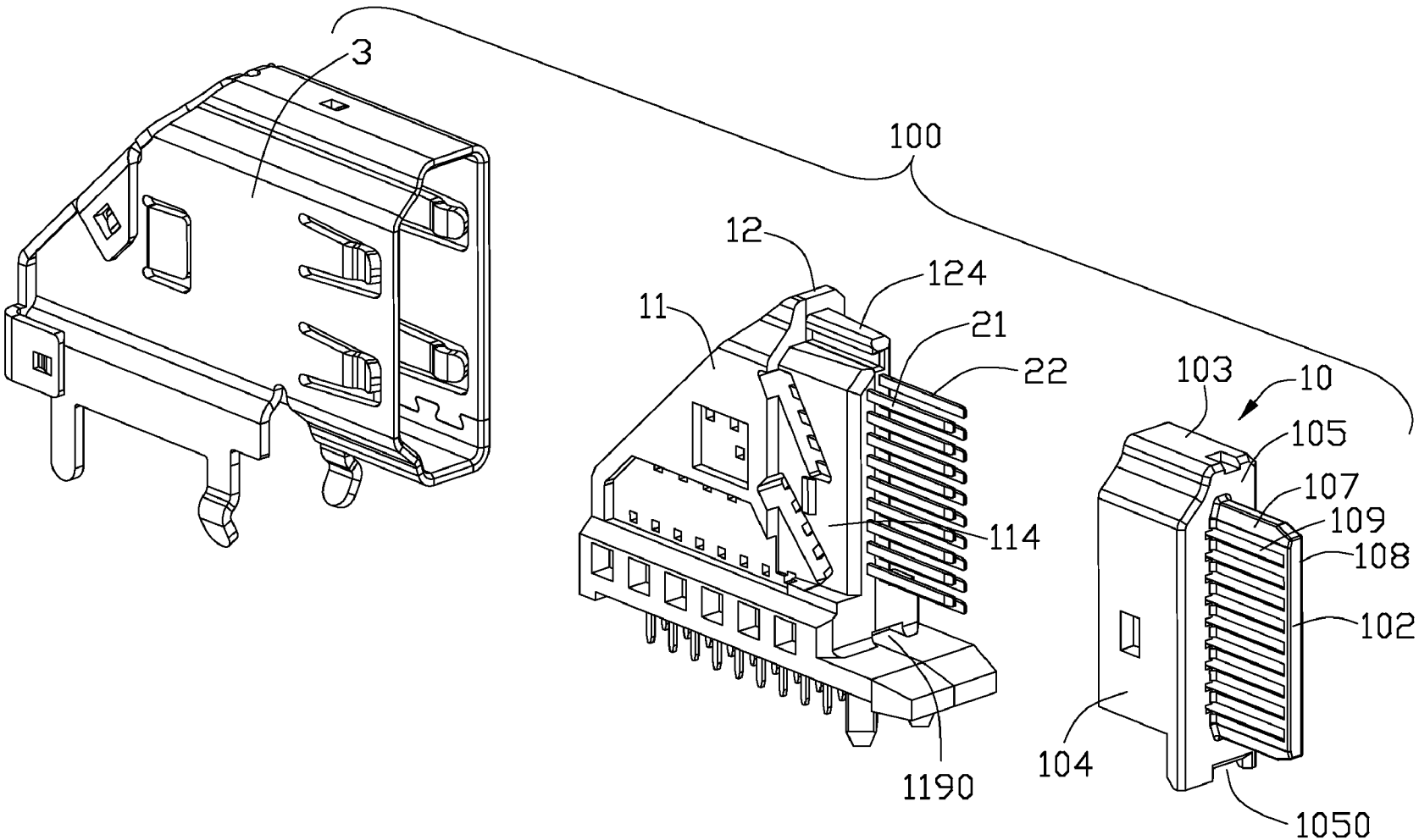
FIG. 3 is a partly exploded view of the electrical connector shown in FIG. 1.
Figure 4:
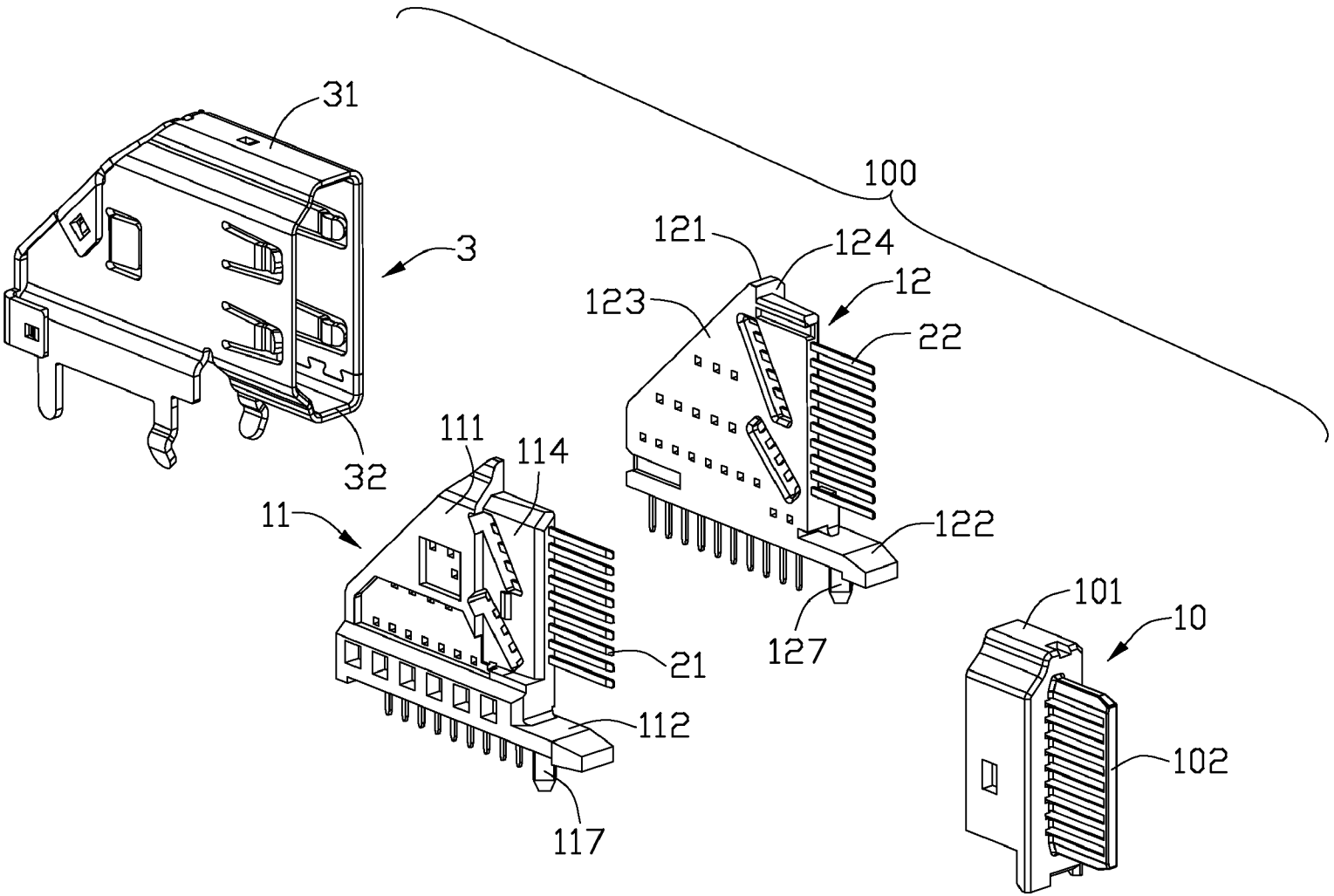
FIG. 4 is another partly exploded view of the electrical connector shown in FIG. 1.
Figure 5:
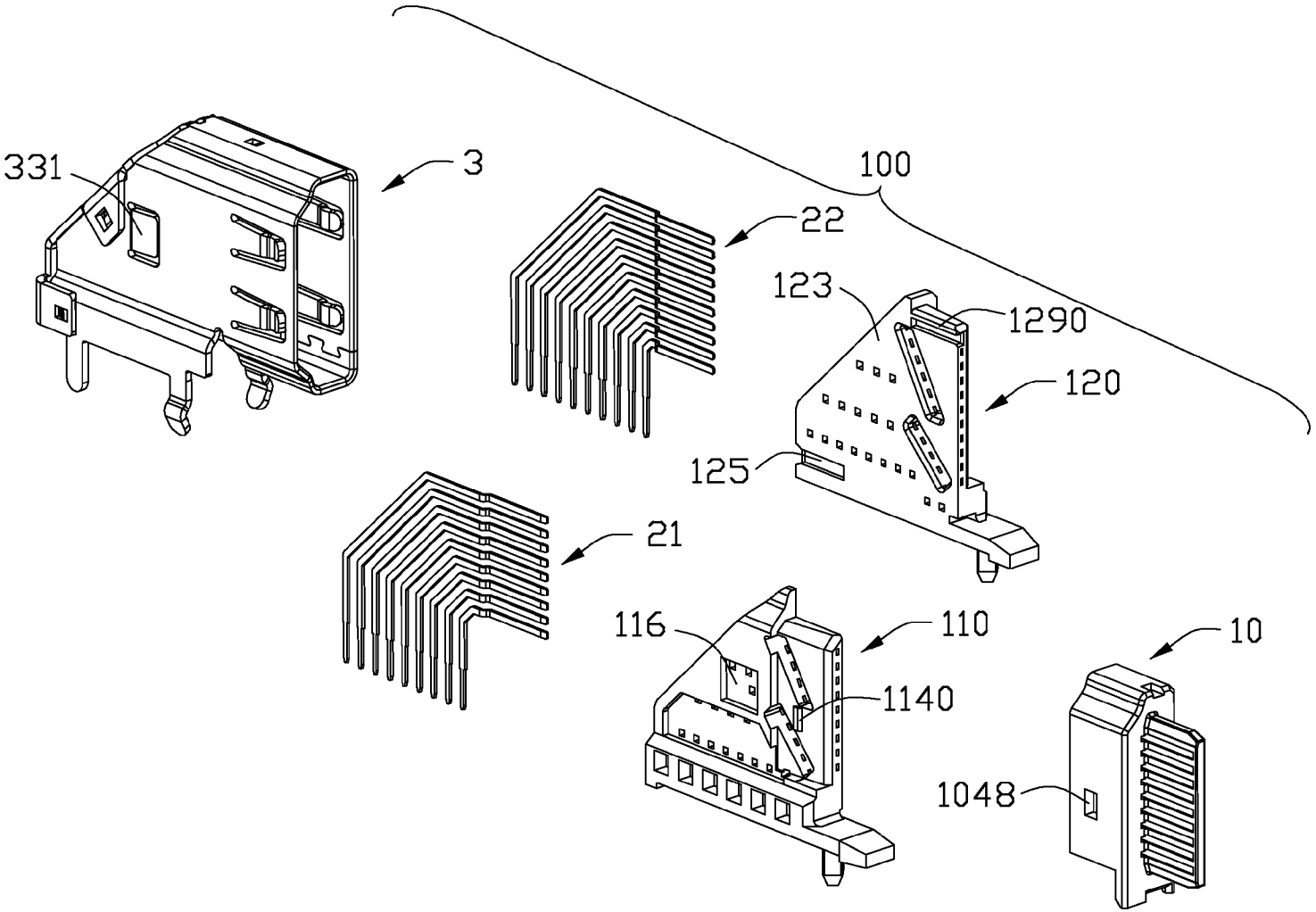
FIG. 5 is an exploded view of the electrical connector shown in FIG. 1.
Figure 6:
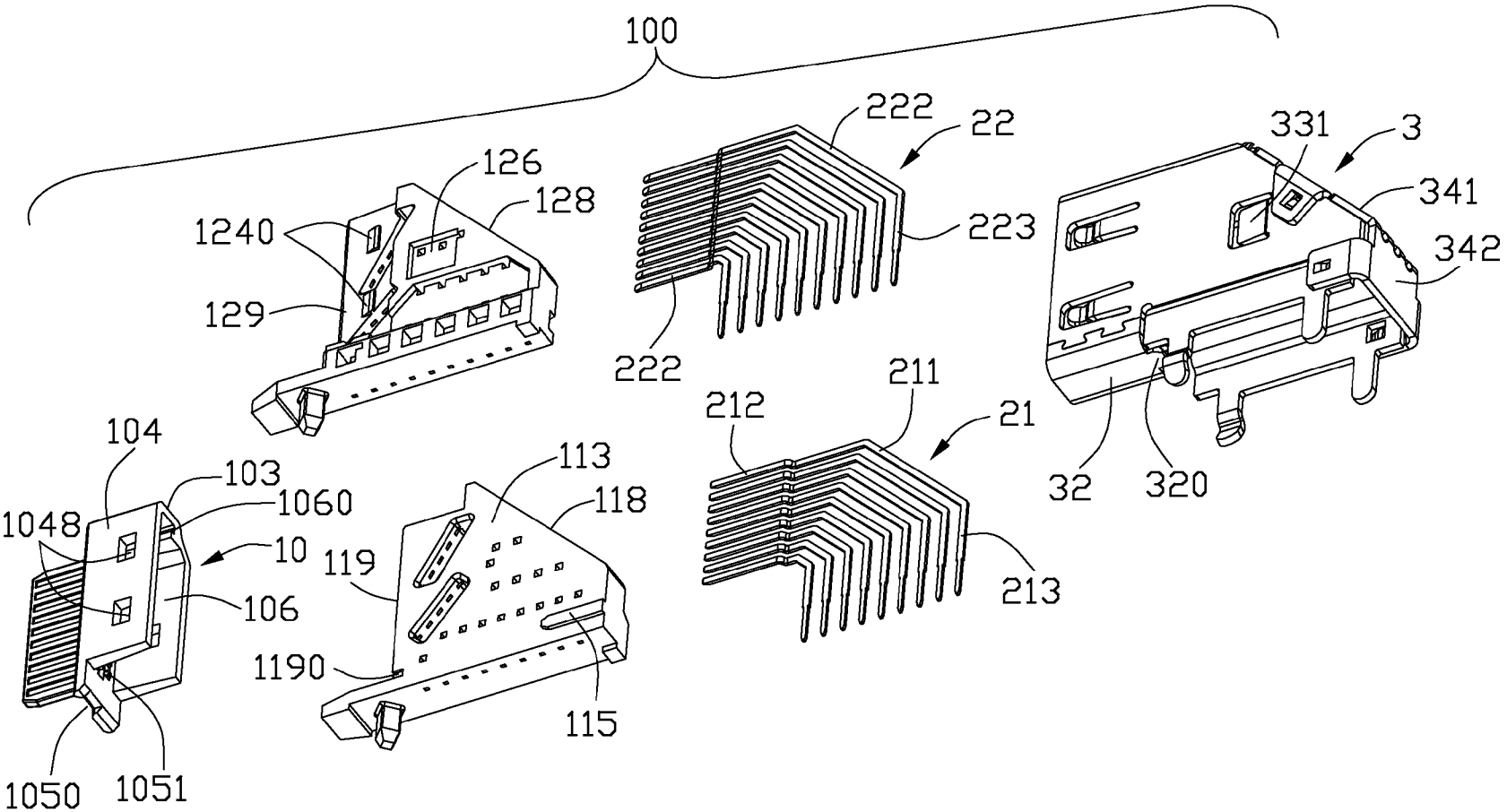
FIG. 6 is another exploded view of the electrical connector shown in FIG. 1.

In the following description, numerous specific details are set forth to provide a thorough understanding of the present invention. However, it will be obvious to those skilled in the art that the present invention may be practiced without such specific details. In other instances, well-known circuits have been shown in block diagram form in order not to obscure the present invention in unnecessary detail. For the most part, details concerning timing considerations and the like have been omitted inasmuch as such details are not necessary to obtain a complete understanding of the present invention and are within the skills of persons of ordinary skill in the relevant art.

Referring to FIGS. 1-6, an electrical connector 100 according to the present invention is disclosed. The electrical connector 100 is an upright HDMI (High-Definition Multimedia Interface) receptacle connector for mating with a HDMI plug (not shown), and includes a front insulative housing 10, a first and second contact modules 11, 12 being retained with each other, and a metal shell 3 enclosing the insulative housing 10 and the contact modules 11, 12.

The insulative housing 10 being molded of dielectric material such as plastic or the like, and includes a base portion 101 and a tongue plate 102 extending horizontally forwardly from the base portion 101. The shell 3 encloses the tongue plate 102 to form a receiving space 35 for receiving the HDMI plug. A plurality of horizontal passageways 109 are formed on two opposite side surfaces 107, 108 of the tongue plates 102. The base portion 101 includes a front wall 105 connected to the tongue plate 102, a top wall 103, and two side walls 104 to form a cavity 106 passing through a lower surface thereof downwardly. The front wall 105 defines a plurality of through holes 1051 passing therethrough and extending from the cavity 106 to the passageways 109, and a first depression 1050 disposed on a bottom portion thereof. The cavity 106 defines a retaining slot 1060 disposed adjacent to the top wall 103 and along a front-to-rear direction. The retaining slot 1060 is The cavity 106 is exterior downwardly and rearwardly to allow the contact modules 11, 12 to be inserted into. The side walls 104 define a number of securing through holes 1048 to secure the contact modules 11, 12.

The first contact module 11 includes a first insulative block 110, and a first row of contacts 21 being insert molded in the first insulative block 110. The second contact modules 12 includes a second insulative block 120, and a second row of contacts 22 being insert molded in the second insulative block 120. The insulative blocks 110, 120 each includes a main body 111, 121 and a supporting plate 112, 122 protruding forwardly from a lower portion of the main body 111, 121. The support plates 112, 122 each protrudes forwardly beyond the front wall 105 of the insulative housing 10. The front portion 119 of the first insulative block 110 defines a second depression 1190 aligned with the first depression 1050 of the insulative housing 10 along the front-to-rear direction, The support plates 112, 122 each has an vertical post 117, 127 to be mounted into a mounting hole of a printed circuit board (not shown). A bottom wall 32 of the shell 3 is supported by the supporting plates 112, 122 of the insulative blocks 110, 120. The first contacts 21 each includes a body portion 211 being inserted into the first insulative block 110, and a contact portion 212 extending forward from the body portion 211 and beyond the first insulative block 110, and a soldering tail 213 extending downwardly from the body portion 211 and beyond the first insulative block 110 to be soldered to the printed circuit board. The second contacts 22 each includes a body portion 221 being inserted into the second insulative block 120, and a contact portion 222 extending forward from the body portion 221 and beyond the second insulative block 120, and a soldering tail 223 extending downwardly from the body portion 221 beyond the first insulative block 120 to be soldered to the printed circuit board. The contact portions 212 of the first contacts 21 pass through the through holes 1051 and are received in the passageways 109 disposed on one side surface 107 of the tongue plate 102. The contact portions 222 of the second contacts 22 pass through the through holes 1051 and are received in the passageways 109 disposed on another side surface 108 of the tongue plate 102. The contact portions 212, 222 of the contacts 21, 22 are exposed to the receiving space 35 for contacting with the HDMI plug.

The first and the second insulative blocks 110, 120 each defines a front portion 119, 129 with a depression 114, 124 recessed from an outer side surface and an upper surface, and a rear end portion 118, 128 connected to the front portion 119, 129. A top portion of the front portion 129 of the first insulative block 120 has a retaining plate 1290 above the front portion 119 of the insulative block 110 retained in the retaining slot 1060 of the insulative housing 10. The depression 114 of the first insulative block 110 is opposited to the depression 124 of the second insulative block 120. The front portions 119, 129 of the insulative blocks 110, 120 each defines a securing projection 1140, 1240 protruding laterally from an inner side wall of the depression 114, 1240 to lock into the through hole 1048 of the insulative housing 10 for preventing the contact modules 11, 12 from moving rearwardly.

The first insulative block 110 defines a first inner surface 113 and a recess 125 recessed from the first inner surface 113 and extending rearwardly therethrough. The second insulative block 120 defines a second inner surface 123 mating with the first inner surface 113, and a rib 115 formed on the second inner surface 123 and locking in the recess 125 for preventing the first insulative block 110 from moving along an upper-to-lower direction with respect to the second insulative block 120. The rear end portions 118, 128 of the first and the second insulative blocks 110, 120 each defines a locking slot 116, 126 disposed on an outer side portion thereof.

The shell 3 can be formed of a single piece of conductive material, such as a metal, by a stamping or forming process. Alternatively, the shell 3 may includes multiple pieces coupled together. The shell 3 includes a top wall 31, a pair of side walls 33, a bottom wall 32, and a rear cover 34 extending downwardly and rearwardly from a rear end of the top wall 31 all of which are locked with each other. The pair of side walls 33 each has a projection 331 protruding inwardly to fix into the locking slot 116, 126 of the insulative block 110, 120 for preventing the contact modules 11, 12 from moving rearwardly, The bottom wall 32 has a rear tab 320 retained in the first depression 1050 and the second depression 1190.

The rear cover 34 encloses rear portions of the contact modules 11, 12, and includes an inclined upper plate 341 and an vertical lower plate 342 extending downwardly from the upper plate 341 both of which define locking plates 344 bending and extending from opposite later sides thereof. The locking plates 343 each has a through locking hole 344. The pair of side walls 33 of the shell 3 defines locating plates 332 protruding outwardly and locking into the locking holes 344 respectively for preventing the rear cover 34 rotating upwardly.

When the electrical connector 100 is in assembly, firstly, the first contact modules 11 and the second contact modules 12 are assembled together along a lateral direction. Nextly, the front portions of the contact modules 11, 12 are inserted forwardly into the cavity 106 of the insulative housing 10. The rear end portions 118, 128 are disposed to exterior of the insulative housing 10 and resist the top wall 103 and the side wall 104 of the insulative housing 10 forwardly to prevent the insulative housing 10 from moving rearwardly. Finally, The shell 3 encloses the insulative housing 10, the contact modules 11, 12. The rear cover 34 encloses the rear end of the contacts modules 11, 12.

Figure 7:
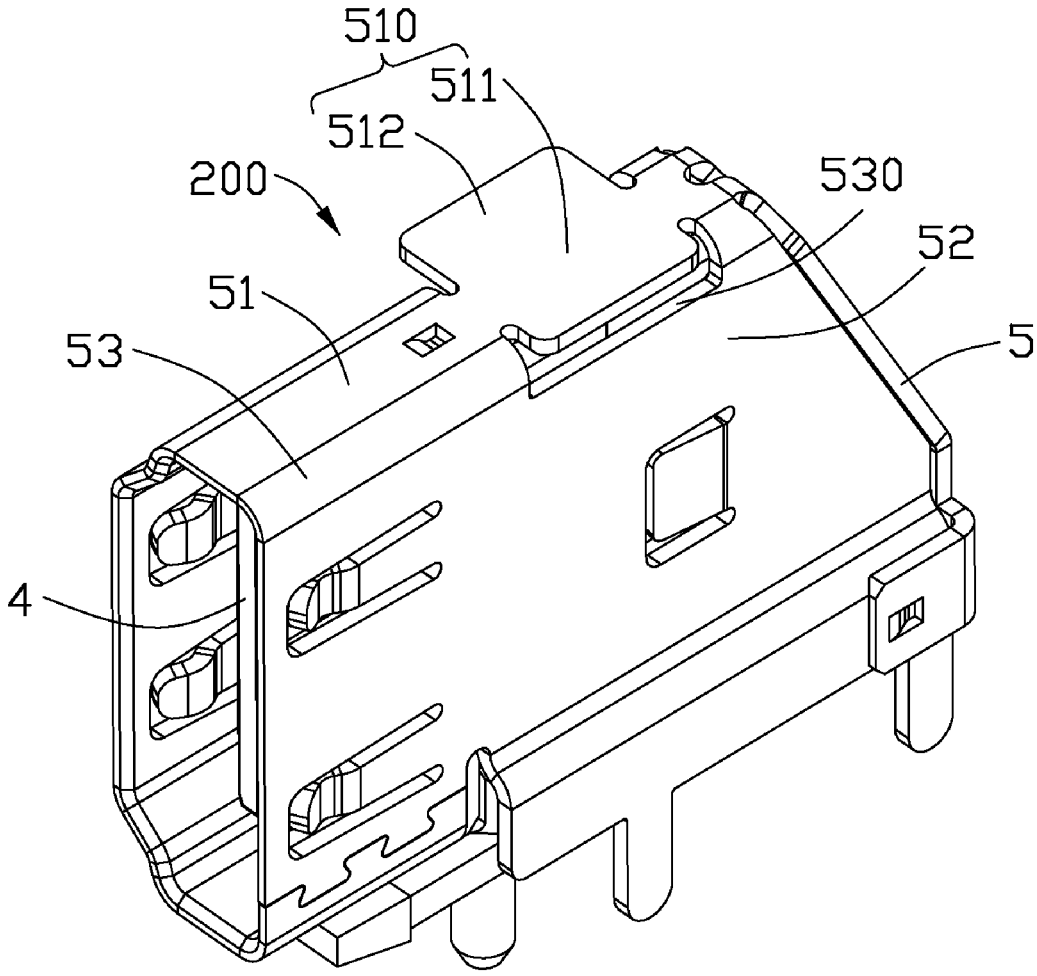
FIG. 7 is a perspective view of an electrical connector according to another embodiment of the present invention.

Referring to FIG. 7, an electrical connector 200 in accordance with another embodiment of the present invention. The electrical connector 200 includes an insulative housing 4, and a metal 5 enclosing the insulative housing 4. The shell 4 includes 5 a top wall 51, a pair of side walls 52, and a pair of bending walls 53 bending and extending downwardly from the top wall 51 to the side walls 52 respectively. A planar horizontal suction plate 510 is connected to the top wall 51 for being absorbed by a suction device (not shown). The suction plate 510 is wider than the top wall 51 along the lateral direction, and includes a middle portion 511, and a pair of side flanges 512 disposed on opposite sides thereof. The middle portion 511 is a part portion of the top wall 51. The side flanges 512 are stamped upwardly from the pair of bending walls 53 and form two opposite through holes 530. All of the middle portion 511 and the side flanges 512 are located on a same level plane.

It is to be understood, however, that even though numerous, characteristics and advantages of the present invention have been set fourth in the foregoing description, together with details of the structure and function of the invention, the disclosed is illustrative only, and changes may be made in detail, especially in matters of number, shape, size, and arrangement of parts within the principles of the invention to the full extent indicated by the broad general meaning of the terms in which the appended claims are expressed.

What is claimed is:

1. An electrical connector comprising:

an insulative housing including a base portion and a mating tongue plate protruding forwardly from the base portion, the tongue plate defining a plurality of passageways, the base portion having a cavity extending rearwardly therethrough, and a plurality of through holes extending forwardly therein and communicating with the passageways and the cavity;

two contact modules retained with each other and each including an insulative block, and a row of contacts being insert molded in the insulative block, the contacts defining contact portions protruding forwardly beyond the insulative block, and soldering tails extending beyond the insulative block for being soldered to a printed circuit board, the contact portions passing through the through holes and being received in the passageways of the tongue plate; and a metal shell enclosing the insulative housing and the contact modules, a receiving space being formed between the shell and the tongue plate for receiving a mating connector, the shell having a top wall and a bottom wall opposite to the top wall; wherein the insulative blocks each defines a front portion inserted in the cavity of the insulative housing for the contact modules being retained with the insulative housing reliably;

wherein at least one of the insulative blocks unitarily defines a supporting plate protruding forwardly to support the bottom wall of the shell.

2. The electrical connector according to claim 1, wherein partly portions except the front portions of the insulative blocks are exposed to exterior with respect to the insulative housing.

3. The electrical connector according to claim 2, wherein the base portion includes a front wall connected to the tongue plate, a top wall, and two opposite side walls extending downwardly from the top wall to form the cavity thereamong, the through holes pass through the front wall, the cavity passes through the base portion downwardly to separate two lower ends of the side walls, the insulative block defines a rear end portion connected to the front portion and resisting the top wall and the side walls of the insulative housing forwardly to prevent the insulative housing from moving rearwardly.

4. The electrical connector according to claim 3, wherein the side walls of the insulative housing define a number of securing through holes, the front portion defines a number of securing projections locking into the securing holes, the cavity has a retaining slot adjacent to the top wall and along a front-to-rear direction, the front portion of one insulative block defines a retaining plate above another front portion and retained in the retaining slot of the insulative housing.

5. The electrical connector according to claim 4, wherein the front portions of the insulative blocks each defines a depression, the side walls are assembled rearwardly to the depressions respectively, the securing projections are disposed in the depressions respectively.

6. The electrical connector according to claim 1, wherein the shell includes a top wall, a pair of side walls each having a projection protruding inwardly, an outer side portion of the insulative block has a locking slot latching with the projection for preventing the contact module from moving rearwardly.

7. The electrical connector according to claim 1, wherein the shell has a pair of side walls extending downwardly from the top wall to the bottom wall, and a rear cover extending from the top wall and enclosing rear portions of the contact modules, the rear plate includes an inclined upper plate and an vertical lower plate extending downwardly from the upper plate, at least one of the upper plate and the lower plate is secured with the side wall of the shell.

8. The electrical connector according to claim 7, wherein the rear cover defines a plurality of locking plates bending and extending forwardly therefrom, each locking plates has a through locking hole, the side wall of the shell defines a plurality of locating plates protruding outwardly and locking into the locking holes respectively.

9. The electrical connector according to claim 3, wherein supporting plate is under the tongue plate, the front wall of the insulative housing has a first depression disposed on a bottom portion thereof, the front portion of the insulative block defines a second depression aligned with the first depression along the front-to-rear direction, the bottom wall of the shell defines a rear tab retained in both of the first depression and the second depression.

10. The electrical connector according to claim 1, wherein the shell includes a top wall, and a planar horizontal suction plate connected to the top wall for being absorbed by a suction device, the pair of side walls bending downwardly from the top wall, the suction plate is wider than the top wall along a left-to-right direction.

11. The electrical connector according to claim 10, wherein the suction plate includes a middle portion, a pair of side flanges disposed on opposite sides thereof, the middle portion is a part portion of the top wall, the side flanges are stamped upwardly from two opposite bending walls between the top wall and the pair of side walls and form two opposite through holes, all of the middle portion and the side flanges are located on a same level plane, and the pair of side flanges defining different dimension in said left-to-right direction.

12. An electrical connector defining a receiving space for receiving a plug, comprising:

a front insulative housing including a base portion defining a cavity communicating with the receiving space, and a tongue plate extending into the receiving space from the base portion along a length direction thereof;

two rear contact modules being assembled together along a transverse direction perpendicular to the length direction, and each including an insulative block and a row of contacts being insert molded in the insulative block, the contacts each including a contact portion located on the tongue plate and exposed to the receiving space for mating with the plug, and a soldering tail extending beyond the insulative block for being soldered to a printed circuit board; and a metal shell attached to at least one of the insulative housing and the contact modules, and enclosing the tongue plate to form the receiving space; wherein the insulative blocks each includes a front portion retained in the cavity and a rear end portion connected to the front portion, the rear end portions of the insulative blocks are disposed on exterior of the cavity;

wherein the shell further has a top wall with a horizontal suction plate adapted for being sucked by a suction device.

13. The electrical connector according to claim 12, wherein the cavity includes a front wall connect to the tongue, a top wall, and a pair of side walls all of which are joined with each other, the front portion of the insulative block defines a depression recessed from an outer side surface thereof to secure the side wall of the insulative housing, the shell has a pair of side walls extending downwardly from the top wall, the suction plate is wider than the top wall along a left-to-right direction.

14. The electrical connector according to claim 12, wherein the shell includes a pair of side walls extending downwardly from the top wall, the side walls each has a bending wall bending and extending downwardly from the top wall, the suction plate includes a middle portion, and a pair of side flanges disposed on opposite sides thereof, the middle portion is a part portion of the top wall, the side flanges are stamped upwardly from the bending walls of the side walls to form two opposite through holes respectively, and all of the middle portion and the side flanges are located on a same level plane.

15. An electrical connector comprising:

an upright insulative housing defining an upright mating port;

a contact module defining an insulative block associated with a plurality of contacts, said housing cooperating with said insulative block to commonly define a whole housing contour including an upward oblique rear edge;

a metallic shell enclosing said whole housing contour, and defining opposite top and bottom walls, and opposite side walls cooperating with said top and bottom walls to commonly enclose said upright mating port, a rear cover unitarily extending from a rear edge of the top wall and including an inclined upper plate linked to said rear edge of the top wall, and a lower plate linked to a lower edge of the upper plate; wherein each of said upper plate and said lower plate is equipped with a pair of locking plates on two sides thereof to respectively latch to the corresponding side walls, respectively.

16. The electrical connector as claimed in claim 15, wherein the bottom wall terminates at a position in a front-to-back direction, where each of the pair of side walls defines a downward extension on which at least one mounting led downwardly extends for mounting to a printed circuit board.

17. The electrical connector as claimed in claim 15, wherein the lower plate is vertical.

18. The electrical connector as claimed in claim 15, wherein the insulative block is discrete from the housing while the shell is of a unitary single piece.

19. The electrical connector as claimed in claim 16, wherein a bottom portion of the whole housing contour is formed by the insulative block rather than the housing.

20. The electrical connector according to claim 16, the wherein the shell defines an enlarged horizontal suction plate on the top wall under condition that the enlarged horizontal suction plate is dimensioned larger than the top wall in a transverse direction, and a centerline of the enlarged horizontal suction plate along a front-to-back direction, which is perpendicular to said transverse direction, is offset from a centerline of the top wall along the front-to-back direction.

* * * * *